US007142126B2

(12) United States Patent
Jeon

(10) Patent No.: US 7,142,126 B2
(45) Date of Patent: Nov. 28, 2006

(54) CARGO CONTAINER HAVING AN AUDIO SYSTEM

(76) Inventor: Byoung-Jin Jeon, 102-2006. Ssangyong Apt..1014 Jeongneung-dong, Seongbuk-gu, Seoul (KR) 136-100

( * ) Notice: Subject to any disclaimer, the term of this patent is extended or adjusted under 35 U.S.C. 154(b) by 377 days.

(21) Appl. No.: 10/481,280

(22) PCT Filed: Jun. 8, 2002

(86) PCT No.: PCT/KR02/01087

§ 371 (c)(1),
(2), (4) Date: Dec. 18, 2003

(87) PCT Pub. No.: WO03/002428

PCT Pub. Date: Jan. 9, 2003

(65) Prior Publication Data

US 2004/0164870 A1 Aug. 26, 2004

(30) Foreign Application Priority Data

Jun. 28, 2001 (KR) ..... 2001-19490 U
Apr. 17, 2002 (KR) ..... 2002-20776

(51) Int. Cl.
*G08B 25/08* (2006.01)

(52) U.S. Cl. ..... 340/692; 340/545.1

(58) Field of Classification Search ..... None
See application file for complete search history.

(56) References Cited

U.S. PATENT DOCUMENTS 3,908,180 A * 9/1975 Braginsky ..... 455/227
4,350,860 A * 9/1982 Ueda ..... 219/705
4,351,999 A * 9/1982 Nagamoto et al. ..... 219/705
4,383,241 A * 5/1983 Kojima et al. ..... 340/460
4,519,027 A * 5/1985 Vogelsberg ..... 700/80
4,984,098 A * 1/1991 Buntsis ..... 360/12
5,467,071 A * 11/1995 Koenig ..... 340/433
5,856,781 A * 1/1999 Michel et al. ..... 340/547
6,008,723 A * 12/1999 Yassan ..... 340/438

FOREIGN PATENT DOCUMENTS

JP 59-178289 11/1984
JP 59-183898 12/1984
JP 05-319437 12/1993

* cited by examiner

*Primary Examiner*—Benjamin C. Lee
(74) *Attorney, Agent, or Firm*—Keusey, Tutunjian & Bitetto, P.C.

(57) ABSTRACT

Disclosed is a cargo container having an audio system, which is capable of broadcasting music and safety regulations for workers when they load or unload freight in or from the cargo container. An audio system is fixed to an inner surface of a corrugated wall of the cargo container. The audio system becomes operated so as to broadcast a radio station when a door of the cargo container is opened. The audio system has a sensor which detects the opening of the door, an automatic power supply switch which automatically supplies electric power from the battery to a printed circuit board when the opening of the door is detected by the sensor, a voice chip which reproduces voice data stored in it when the electric power is supplies through the automatic power supply switch, an a radio signal receiving section which is turned on and receives a radio broadcast signal when data reproductions by the voice chip is completed.

3 Claims, 7 Drawing Sheets

CARGO CONTAINER HAVING AN AUDIO SYSTEM

TECHNICAL FIELD

The present invention relates to a cargo container used in export freight shipment, inland cargo transportation, etc., and more particularly to a cargo container having an audio system capable of broadcasting music and safety regulations for workers when they load or unload freight in or from the cargo container.

BACKGROUND ART

As generally known in the art, a cargo container is a standardized container used in protecting transported freight from the surroundings, preventing the freight from being damaged, and containing various freight, thereby facilitating the transportation of the freight. The cargo container as described above is inevitably used in the transportation of import and export freight and the inland cargo transportation by such companies as Intermodal Service in America and Swapbody in Europe.

Further, the cargo containers used in transporting freight as described are standardized so that they can be easily shipped on and transported by container ships, vehicles, etc. In order to ship the standardized cargo containers on a container ship, many workers have to do the job of loading and unloading freight in and out of the cargo container for long time.

However, when workers do the job of loading and unloading a large quantity of freight in and out of the cargo container, the workers may become very tired due to long continuous work, so that they may get injured or the loaded or unloaded freight may be damaged.

Further, the workers usually do the job of loading and unloading the freight without preliminary knowledge about damage or defect in the container itself, they are apt to load freight in a damaged or defective container, for example, in a cargo container having cracks in its ceiling, walls, or bottom. As a result, it is not an unusual case that the load being transported in a cargo container gets damaged.

SUMMARY OF THE INVENTION

Accordingly, the present invention has been made to solve the above-mentioned problems occurring in the prior art, and an object of the present invention is to provide a cargo container having an audio system, which can broadcast safety regulations music for workers on the job of loading or unloading freight in and from the cargo container, thereby not only preventing the workers from getting injured or the freight from being damaged, but also preventing the workers from being bored and improving their working efficiency.

In order to accomplish this object, there is provided a cargo container, in which freight is loaded, the cargo container having an audio system fixed to an inner surface of a wall of the cargo container, the audio system comprising a radio and a battery, the audio system being turned on so as to broadcast a radio station when a door of the cargo container is opened, wherein the audio system further comprises: a sensor which detects opening of the door; an automatic power supply switch which automatically supplies electric power of the battery to a printed circuit board when the opening of the door is detected by the sensor; a voice chip which reproduces voice data stored in the voice chip when the electric power is supplied through the automatic power supply switch; and a radio signal receiving section which is turned on and receives a radio broadcast signal when data reproduction by the voice chip is completed.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF PREFERRED EMBODIMENTS

Hereinafter, a preferred embodiment of the present invention will be described with reference to the accompanying drawings.

Figure 1:
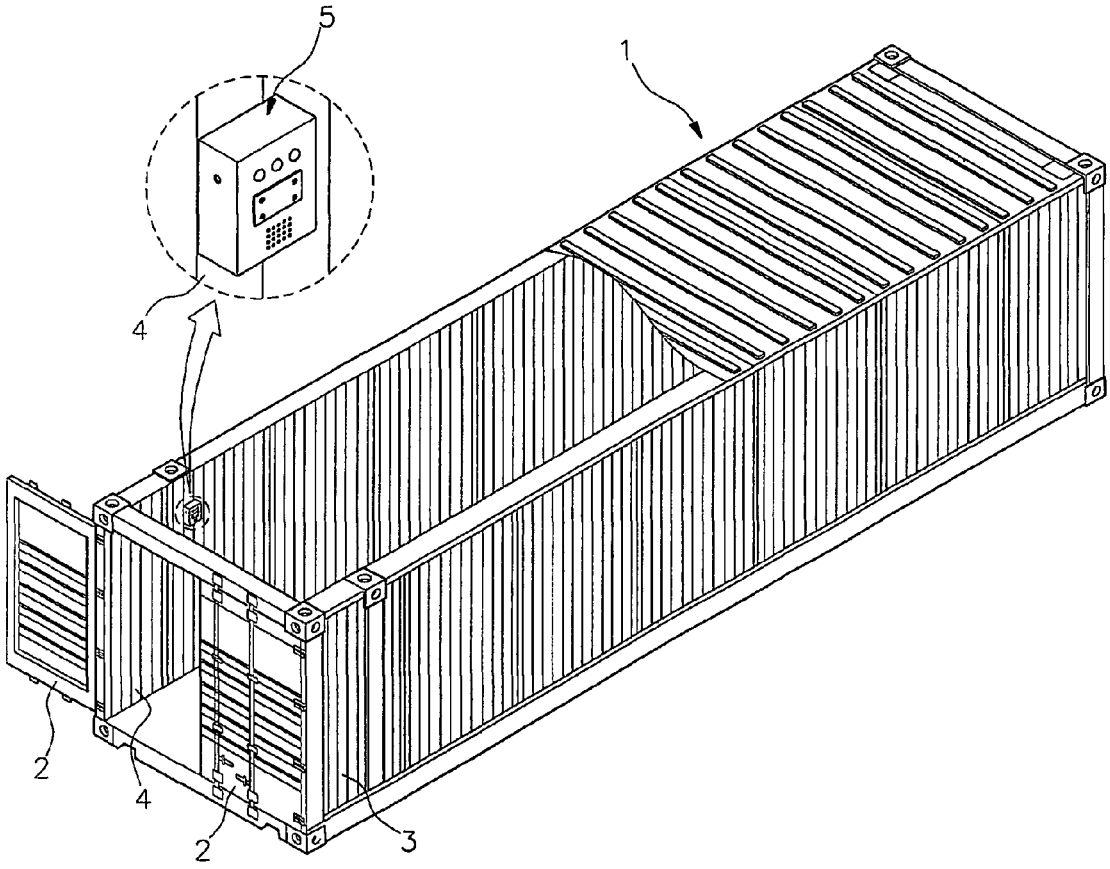
FIG. 1 is a perspective view of a cargo container according to the present invention.

FIG. 1 is a perspective view of a cargo container according to the present invention. As shown, the cargo container 1 has an audio system 5 fixed to an inner surface of a side wall of the cargo container 1. When a door 2 of the cargo container 1 is opened, the audio system 5 is automatically turned on to broadcast safety regulations and music, or to tune in a radio broadcast.

Figure 2:
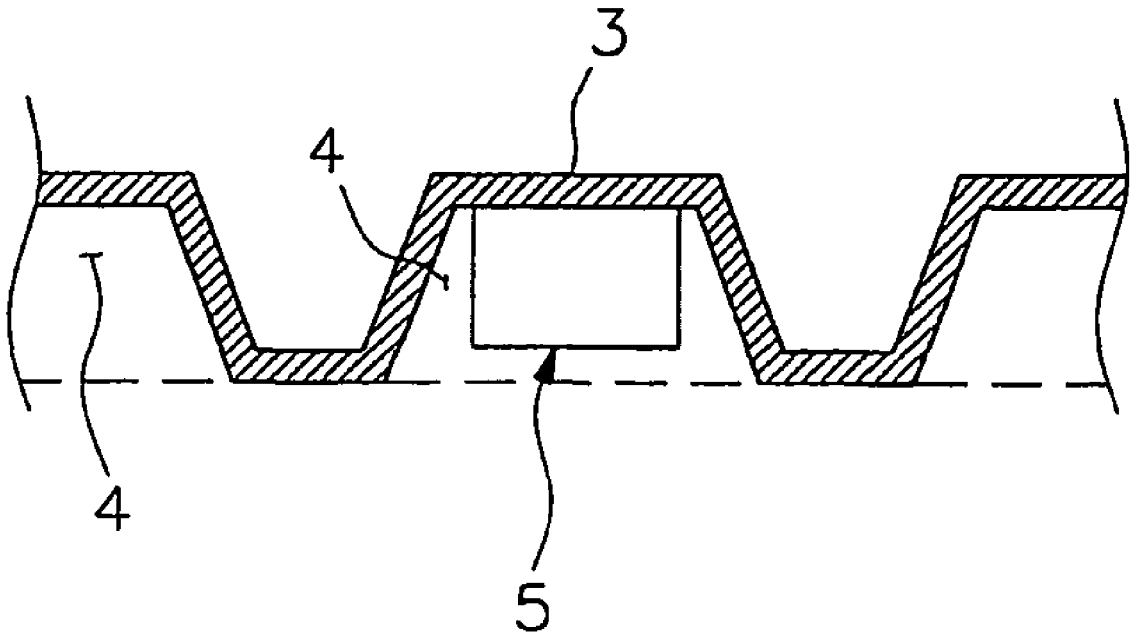
FIG. 2 is a partial sectional view of a side wall of the cargo container shown in FIG. 1, which shows an audio system installed in a recess formed inside of the side wall.

Referring to FIG. 1, the cargo container 1 has a long rectangular shape. The cargo container 1 has an internal cargo space for containing freight, which is defined by a ceiling, a bottom, walls 3, and the door 2 of the cargo container 1. The freight can be loaded and unloaded through the door 2 forming the rear surface of the cargo container 1. The wall 3 has a corrugated surface, that is, the wall 3 has a plurality of protruding sections spaced at regular intervals and integrally connected with each other, each of which is shaped like a vertically extending ridge and has a trapezoidal horizontal section as shown in FIG. 2. In the present embodiment, the audio system 5 is attached to an inner surface of a recess 4 formed adjacent to the door 2, which is formed inside one of the protruding sections. That is, although the location of the audio system 5 may be selected variously according to the construction of the cargo container, in the case of the cargo container shown in FIG. 2, it is preferred that the audio system 5 is fixed to the door 2 or the recess 4 formed inside of the wall 3, so as to prevent the audio system 5 from being exposed. Further, in the case of a freezing container, it is preferred that the audio system 5 is installed to a freezing system located at a front part of the freezing container, so as to prevent the audio system 5 from interfering with loaded cargo.

Figure 3A:
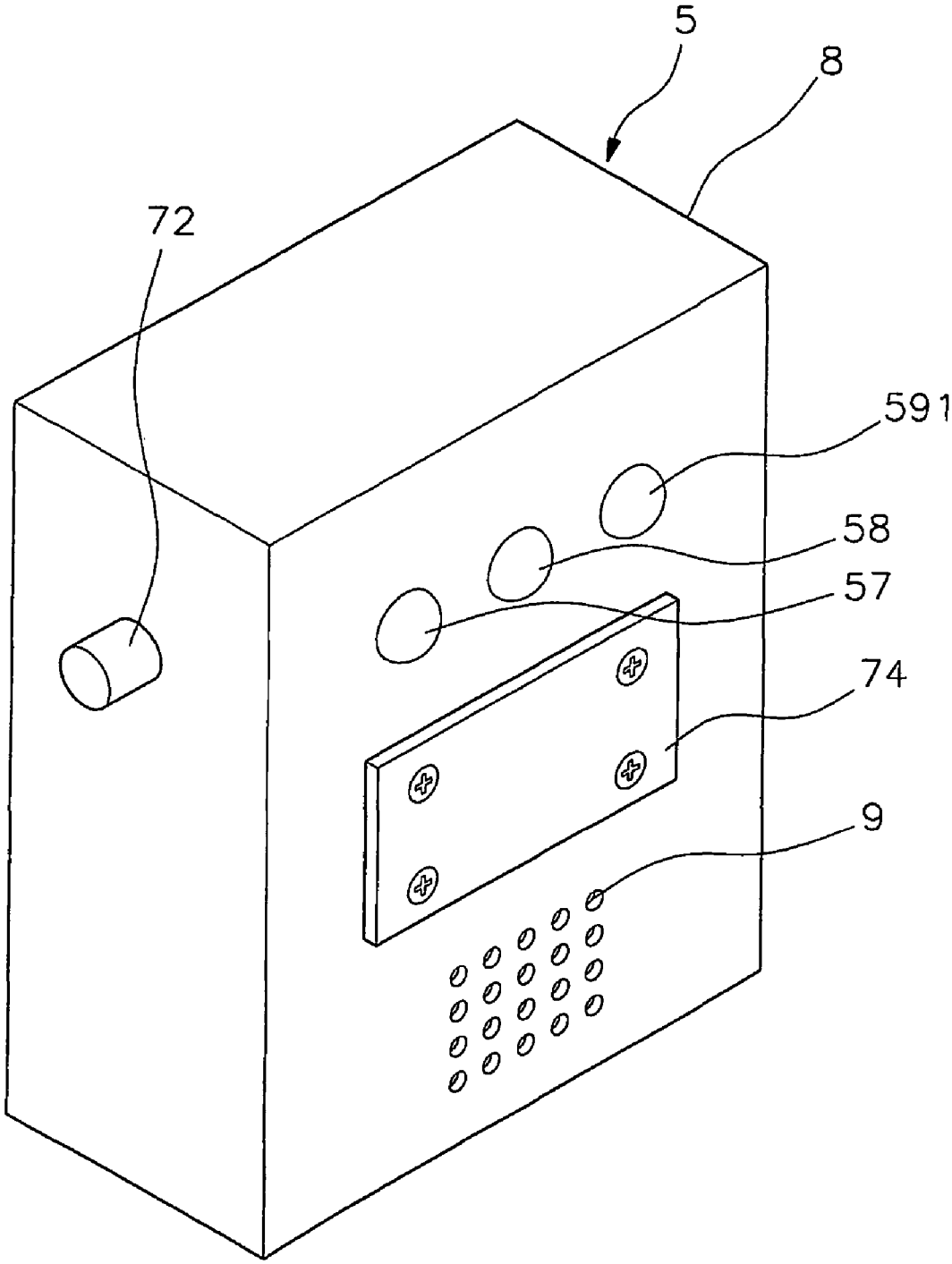
FIG. 3A is a front perspective view of an audio system installed in a cargo container according to the present invention.
Figure 3B:
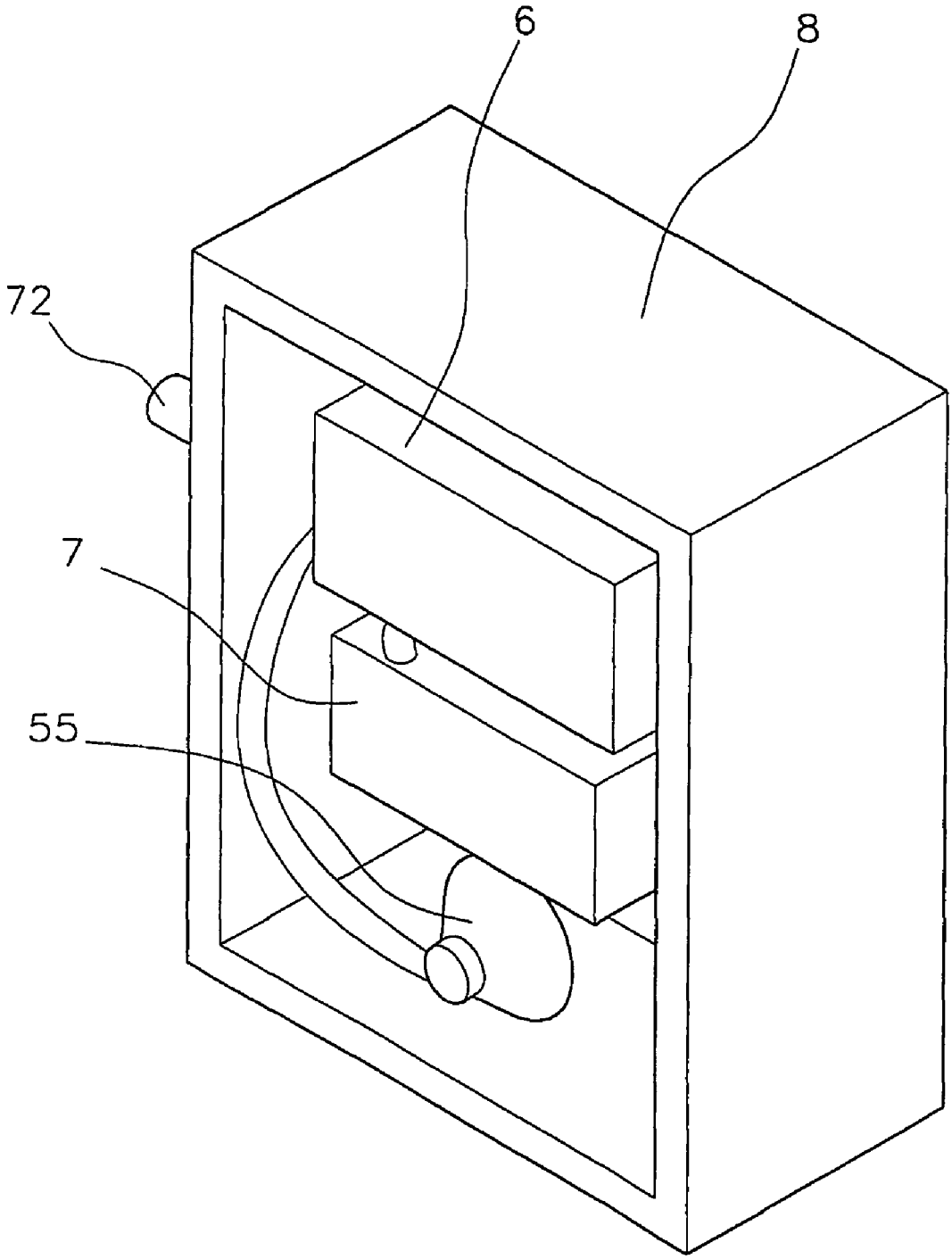
FIG. 3B is a rear perspective view of an audio system installed in a cargo container according to the present invention.

Further, the audio system 5 is housed in a case 8 as shown in FIG. 3A, so as to prevent water from coming into the audio system 5 when the cargo container is washed. As shown in FIG. 3B, the audio system 5 housed in the case 8 includes a printed circuit board 6 on which electronic devices capable of recording and reproducing voice and for receiving radio broadcast are packaged, a battery 7 for supplying electric power to the printed circuit board 6, and a speaker 55. Further, the audio system 5 has a plurality of speaker holes 9 formed through a portion of the case 8, to which the speaker 55 is attached, so that sound can be propagated well through the speaker holes 9. The audio system 5 also has a battery case cover 74 so as to enable the battery 7 to be easily replaced. Especially, the audio system 5 according to the present invention has a waterproof construction for protecting circuit elements when the interior of the cargo container is washed by water, etc. That is, such components as a manual switch 72, a tuning button 58, and a reset button 591 are prevented from being soaked in water by rubber packings, etc., and the speaker holes 9 are covered by the water guide covers 91 disposed inside of the case so that water cannot reach interior components but flows down along the guide covers 91. In this case, in order to enable sound to be smoothly propagated, fine apertures may be formed through the water guide cover 91. This waterproof construction is only one example, but various waterproof constructions may employed by the audio system in the container according to the present invention.

Figure 3C:
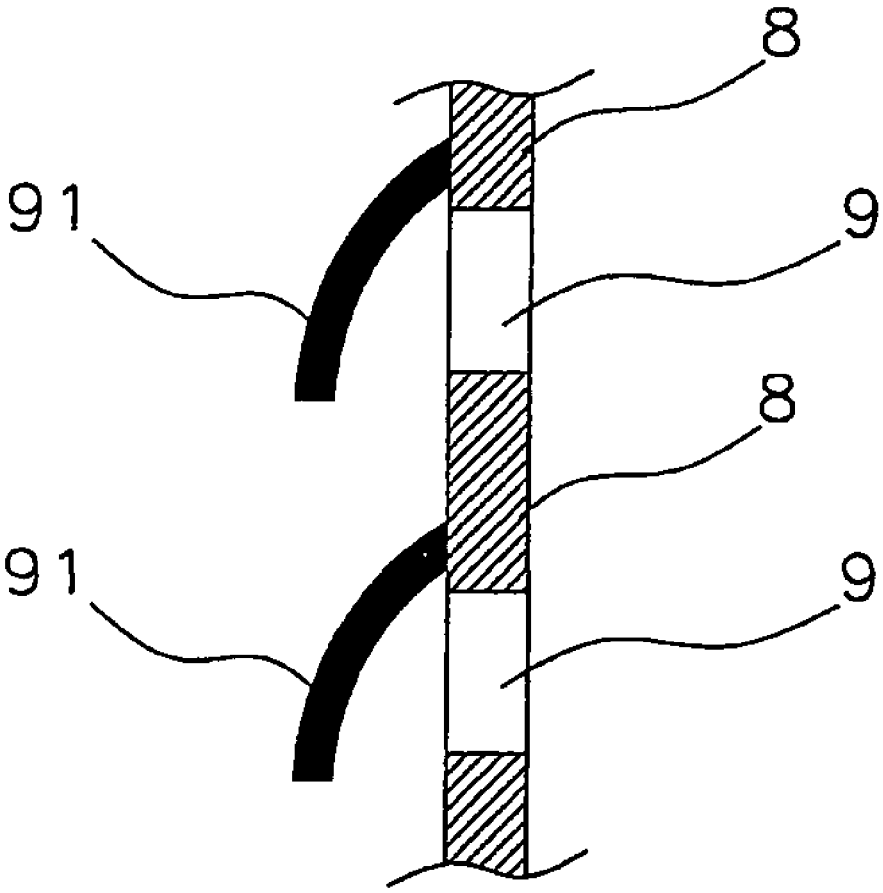
FIG. 3C is a partial sectional view showing water guide covers and speaker holes covered by the water guide covers, which are employed in an audio system installed in a cargo container according to the present invention.

The shape of the audio system 5 shown in FIGS. 3A to 3C is only an example, but the audio system 5 may have various shapes according to the kind and construction of the cargo container, and the location at which the audio system 5 is installed.

Figure 4:
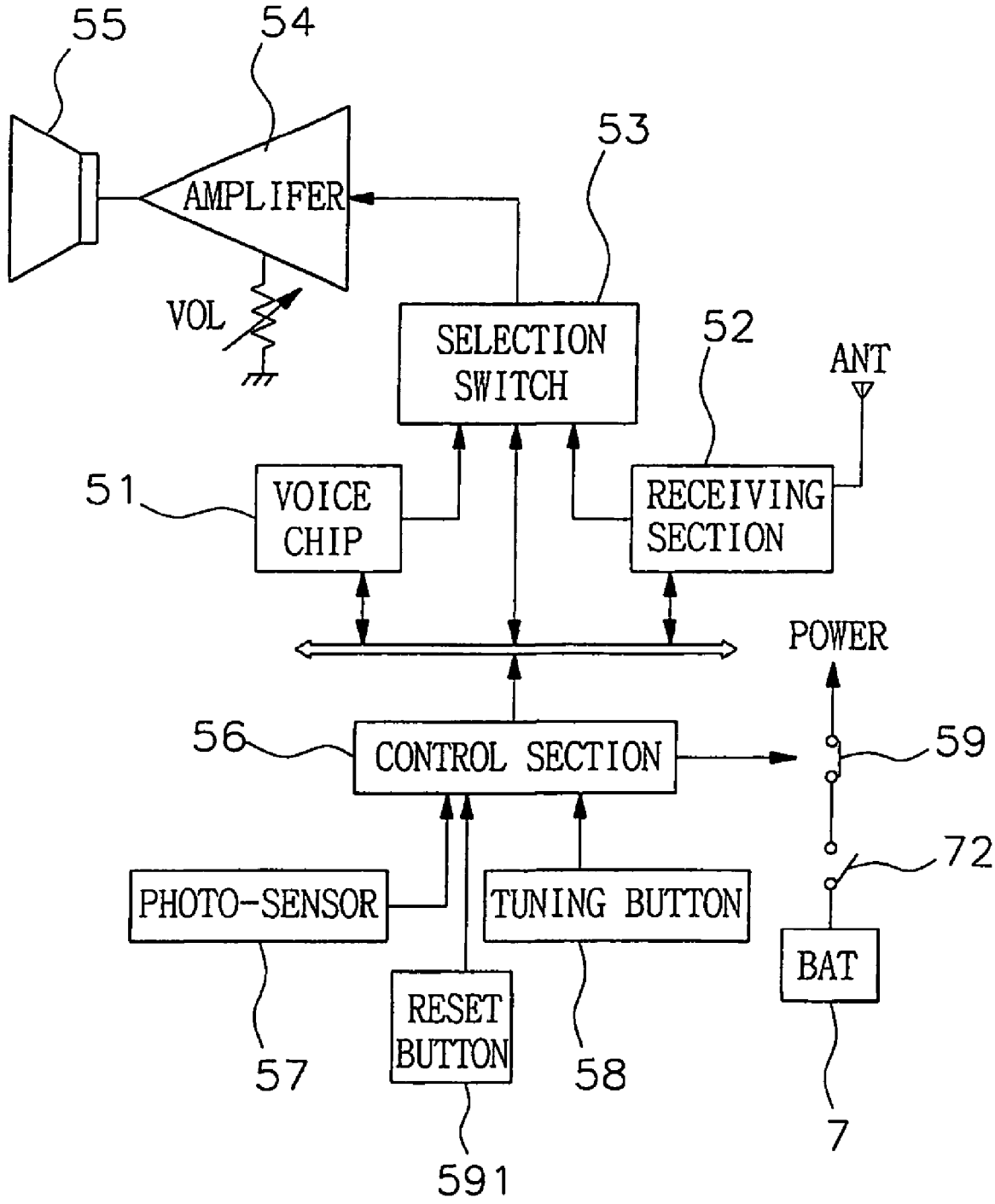
FIG. 4 is a schematic block diagram of an audio system employed in a cargo container according to the present invention.

FIG. 4 is a schematic block diagram of an audio system employed in a cargo container according to the present invention.

Referring to FIG. 4, the audio system 5 according to the present invention includes a voice chip 51, an antenna, a radio signal receiving section 52, a selection switch 53, an amplifier 54, a speaker 55, a control section 56, a photo-sensor 57, a scan button 58, a reset button 591, an automatic power supply switch 59, a battery 7, a manual switch 72, and a volume control Vol.

The voice chip 51 may be a voice synthesis LSI (MLC1036) of an external ROM type or a single chip voice record/playback device (ISD5008) containing a flash memory which enables recording and reproduction. That is, the desired voice can be recorded when a flash memory capable of reading/writing is employed as a medium for storing voice data, while voice data can be easily replaced by just replacing the ROMs when an external ROM type is employed as the medium.

The voice chip 51 employed in the cargo container according to the present invention stores voice data containing safety regulations which workers should obey on the job, music data, etc. Especially in the case of cargo containers containing exported goods, the voice chip 51 should store the safety regulations in versions of languages of the countries to which the goods are exported.

The radio signal receiving section 52 is tuned and receives a broadcasting signal, which is selected by the scan button or the tuning button 58 among radio frequency (RF) broadcasting signals received through the antenna. Also, the radio signal receiving section 52 demodulates the received and selected signal, so as to output an analog audio signal.

The selection switch 53 selects and outputs a voice signal inputted from the radio signal receiving section 52 or a voice signal inputted from the voice chip 51 according to a control signal. The amplifier 54 amplifies the voice signal selected by the selection switch 53, so as to operate the speaker 55, and the speaker 55 converts the electric voice signal to sound which workers can hear. In this case, the workers can operate the volume control Vol so as to change its resistance and the amplitude of the amplifier 54, thereby adjusting volume of the sound.

The photo-sensor 57 detects the opening of the door 2. When the door 2 is opened, the photo-sensor 57 senses light and transmits a detection signal to the control section 56. The scan button 58 is operated by workers when they want to select a radio broadcast. Although the photo-sensor 57 is employed as an element for detecting the opening of the door 2 in the present embodiment, other detecting means such as a limit switch or a contact switch may be employed.

The control section 56 may be a microcomputer or a simple logic circuit. When the control section 56 receives a detection signal from the photo-sensor 57, the control section 56 controls the automatic power supply switch 59 to turn on the electric power, and operates the voice chip 51 to reproduce the safety regulations stored in the voice chip 51. Also, the voice chip 51 controls the selection switch 53, so as to enable the desired voice signal in the voice chip 51 to be selected, amplified in the amplifier 54, and then outputted through the speaker 55. Following the safety regulations, when all data stored in the voice chip 51 including music have been reproduced, the voice chip 51 is turned off and the radio signal receiving section 52 is turned on, so that a radio broadcast is received. That is, since the time of reproducing data stored in the voice chip 51 is limited to several minutes or perhaps less than an hour, the radio signal receiving section 52 is turned on so that a radio broadcast is received, so as to reduce the boredom due to long-time labor. When voice data storage capacity of the voice chip 51 is increased, the reproduction time may be prolonged. According to necessities, the voice chip 51 can be controlled to perform repetitive reproduction.

The radio signal receiving section 52 is an AM/FM radio reception chip capable of receiving AM broadcasts and FM broadcasts, and has an automatic scanning function capable of automatically searching for radio stations. The workers can search for and listen to various radio broadcasts by operating the control section 56. In this case, when a radio broadcast is received, the control section 56 controls the selection switch 53 to select an audio signal inputted from the radio signal receiving section 52. Then, the selection switch 53 transmits the audio signal, inputted from the radio signal receiving section 52, to the amplifier 54.

In the meantime, electric power necessary for the audio system described above is supplied by the battery 7. According to a control signal of the control section 56, the automatic power supply switch 59 connects or disconnects the electric power of the battery 7 supplied to the audio system 5. It is preferred that the audio system further includes the manual switch 72 by which the electric power can be manually turned on or off. In this case, a manager or a worker can turn off the electric power, when the cargo container is being transported for long time, or when no labor is being done while the door 2 is open.

Figure 5:
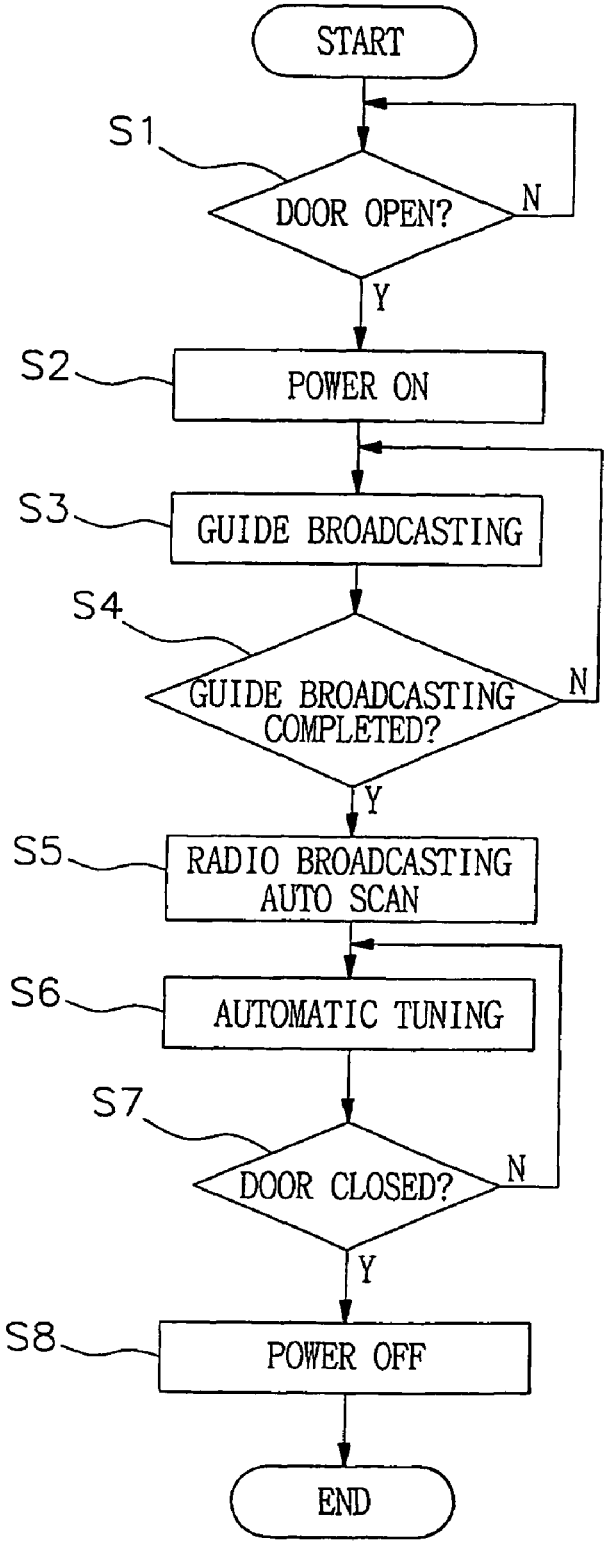
FIG. 5 is a flow chart showing a sequence in which an audio system employed in a cargo container according to the present invention is operated.

FIG. 5 is a flow chart showing a sequence in which an audio system employed in a cargo container according to the present invention is operated.

Referring to FIG. 5, when the door 2 is opened, the photo-sensor 57 detects the open state and transmits a detection signal to the control section 56 (step S1). Then, the control section 56 turns on electric power, and operates the voice chip 51 to perform a guide broadcasting including safety regulation (steps S2 to S4).

When the information broadcasting is completed, the radio function is turned on, so that workers can hear a radio broadcast by means of automatic scanning, and the electric power is turned off when the door 2 is closed (steps S5 to S8).

INDUSTRIAL APPLICABILITY

As described above, in a cargo container according to the present embodiment described above, an audio system is installed in a recess formed inside of the corrugated wall of the cargo container, so that workers in the cargo container can hear music, etc. However, the location of the audio system is not limited to that in the present embodiment but can be selected variously.

Especially in the case of a freezing container, in which a freezing system is disposed at a side opposite to the container door and is always operated by electric power from a generator, it will do to fix only a sound device of the audio system to an inner wall surface of the freezing system while operating the audio system by means of the electric power for operating the freezing system. Moreover, an image system such as a television may be installed in the container.

According to the present invention as described above, an audio system can be installed in all kinds of containers such as containers used in shipping exported freight and containers used in inland freight transportation, so as to broadcast safety regulation and music for workers when they load and unload freight to and from the cargo container, thereby not only preventing the workers from getting injured and the freight from being damaged, but also preventing the workers from being bored and improving their working efficiency.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A cargo container, in which freight is loaded, the cargo container having an audio system fixed to an inner surface of a wall of the cargo container, the audio system being turned on automatically or manually so as to broadcast a radio station when a door of the cargo container is opened, wherein the audio system further comprises:

a voice chip capable of providing safety regulations for workers working in the cargo container and information on freight and/or cargo container;

a sensor which detects opening of the door;

an automatic power supply switch which automatically supplies electric power of a battery to a printed circuit board when the opening of the door is detected by the sensor;

the voice chip reproduces voice data stored in the voice chip when electric power is supplied through the automatic power supply switch; and a radio signal receiving section which is turned on and receives a radio broadcast signal when data reproduction by the voice chip is completed.

2. A cargo container as claimed in claim 1, wherein the cargo container has a corrugated wall and the audio system is fixed in a recess formed in one of the corrugated wall, a container door and a front top rail, so that the audio system is prevented from interfering with the freight loaded in the cargo container.

3. A cargo container as claimed in claim 1, wherein the cargo container is a freezing container and the audio system is fixed to a freezing system disposed in the freezing container.

* * * * *